US008020400B2

(12) United States Patent
Neumann

(10) Patent No.: US 8,020,400 B2
(45) Date of Patent: Sep. 20, 2011

(54) REFRIGERATION DEVICE

(75) Inventor: Michael Neumann, Munich (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 627 days.

(21) Appl. No.: 11/666,533

(22) PCT Filed: Oct. 10, 2005

(86) PCT No.: PCT/EP2005/055137

§ 371 (c)(1),
(2), (4) Date: Apr. 27, 2007

(87) PCT Pub. No.: WO2006/045696

PCT Pub. Date: May 4, 2006

(65) Prior Publication Data

US 2009/0031745 A1 Feb. 5, 2009

(30) Foreign Application Priority Data

Oct. 29, 2004 (DE) ..... 10 2004 052 621

(51) Int. Cl.
*F25D 19/00* (2006.01)

(52) U.S. Cl. ..... 62/298; 62/498

(58) Field of Classification Search ..... 62/298, 62/440, 443, 498
See application file for complete search history.

(56) References Cited

U.S. PATENT DOCUMENTS

| | | | | |
|---|---|---|---|---|
| 3,871,188 | A * | 3/1975 | Vold et al. | 62/298 |
| 3,995,922 | A | 12/1976 | Ohashi | |
| 4,317,527 | A * | 3/1982 | Belleville | 220/4.28 |
| 4,348,068 | A * | 9/1982 | Hawkins et al. | 312/317.1 |
| 4,457,140 | A * | 7/1984 | Rastelli | 62/261 |
| 4,723,418 | A * | 2/1988 | Whitmer, II | 62/298 |
| 4,917,256 | A | 4/1990 | Kruck et al. | |
| 6,459,590 | B2 | 10/2002 | Malnati | |
| 2006/0144058 | A1 | 7/2006 | Kentner et al. | |

FOREIGN PATENT DOCUMENTS

WO WO 2005/090884 9/2005

OTHER PUBLICATIONS

International Search Report PCT/EP2005/055137.

* cited by examiner

*Primary Examiner* — Melvin Jones
(74) *Attorney, Agent, or Firm* — James E. Howard; Andre Pallapies

(57) ABSTRACT

A refrigeration device comprising a refrigeration circuit that contains an evaporator, a condenser and a compressor, in addition to electronic components for operating the refrigeration device. According to the invention, all the electronic components are combined in an electronic unit.

17 Claims, 9 Drawing Sheets

REFRIGERATION DEVICE

Figure 1:
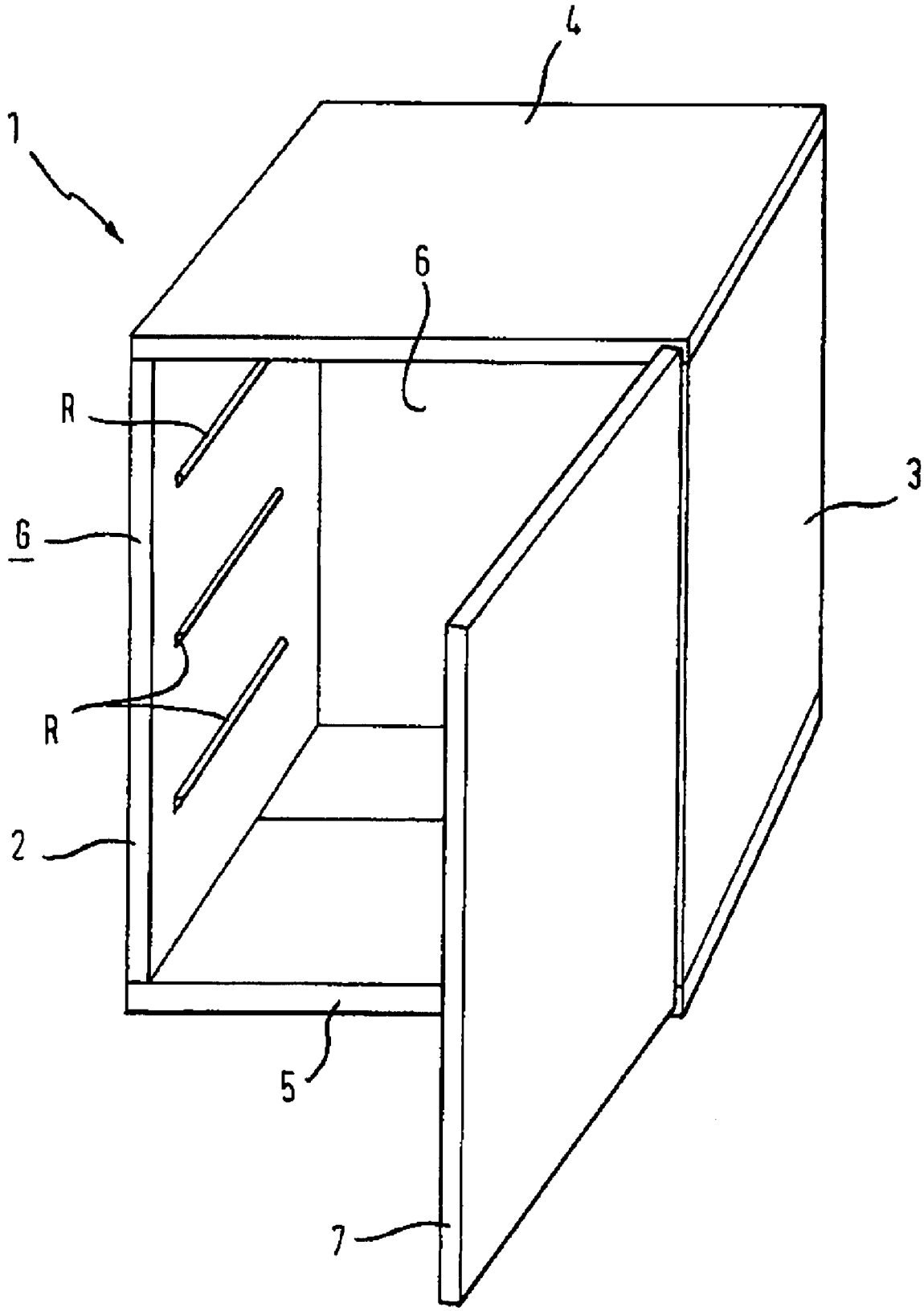

The invention relates to a refrigeration device comprising a refrigeration circuit that contains an evaporator, a condenser and a compressor, in addition to electronic components for operating the refrigeration device.

In addition to the refrigeration circuit, a refrigeration device contains electronic components, such as a control system for maintaining a theoretical temperature inside the refrigeration device, a temperature sensor for measuring the current temperature, or a lighting system inside the housing of the refrigeration device. The electronic components are normally installed at different points inside or on the refrigeration device and are connected to electric cables. The cables are laid inside the housing of the refrigeration device in the form of cable trees, for example, by packing them in plastic foam in the housing during its manufacture, for example.

The object of this invention is therefore to construct a refrigeration device in such a manner that the number of electric cables to be laid is reduced.

The object of the invention is achieved by a refrigeration device comprising a refrigeration circuit containing an evaporator, a condenser and a compressor, in addition to electronic components for operating the refrigeration device, characterised in that all the electronic components are assembled together to form one electronic unit. By assembling all the electronic components of the refrigeration device together to form one single electronic unit, conditions are created for reducing the number of electric cables. The electronic components include, for example, a temperature sensor, the temperature control electronics, a setting device for setting the theoretical temperature or a lighting device for illuminating the interior of the housing.

According to an embodiment of the refrigeration device of the invention this is a modular refrigeration device which comprises a plurality of planar thermally insulated elements which can be connected to each other and detached from each other and, when connected, form a housing of the refrigeration device. One advantage of this embodiment is that the refrigeration device according to the invention, when disassembled, i.e. dismantled, can be delivered to an end consumer, for instance, so that the latter can assemble the planar thermally insulated element, which include, for example, two lateral elements, one bottom element, one ceiling element and a rear wall, to form one functional refrigeration device. However, planar thermally insulated elements may, for example, also be a combination of one lateral element and one ceiling element, i.e. a planar thermally insulated element is part of the housing of the refrigeration device. The individual planar thermally insulated elements may each comprise an inner lining and an outer lining, which enclose a cavity filled with thermal insulation material. If the rear wall is to be designed in a particularly compact manner, it may comprise a recess arranged in the lower region of the rear wall, in which recess the compressor is fastened. The size of the recess is preferably adapted to the spatial expansions of the compressor, and therefore preferably does not extend throughout the width of the rear wall. To enable the compressor to discharge exhaust heat to the air surrounding the assembled refrigeration device, the recess can be made accessible from the outside of the housing.

If the electricity supply for the electronic unit derives from the rear wall on which the refrigeration circuit is possibly arranged, as provided for according to a further variant of the refrigeration device of the invention, the cost of the electricity supply to the entire refrigeration device can then be minimised and the refrigeration device can therefore be designed as compactly as possible.

If the refrigeration device according to the invention is a modular refrigeration device, provision is made, in particular, for it to be assembled by a customer him/herself at home, for example. In addition to a mechanical connection of the planar thermally insulated elements, it may also be necessary, according to the design, to make any electrical connections, e.g. connecting an electric cable from the refrigeration control system to the refrigeration circuit. Such an electrical connection can be made relatively easily when, according to a preferred embodiment of the refrigeration device of the invention an electronic contact device is integrated in the rear wall, which device automatically contacts electrically, during the mechanical connection of the rear wall to a further planar thermally insulated element, an electrical counter-contact device integrated in this planar thermally insulated element. Such a contact/counter-contact device is, for example, an electrical plug-socket device, and it is advantageous for the contact device to be fastened to the point on the rear wall which lies adjacent to the further planar thermally insulated element after connection.

To ensure, in the case of the modular refrigeration device, that the refrigeration device according to the invention has as few electrical connection points as possible, both the electricity supply for the electronic unit and electrical control signals from the electronic unit to the refrigeration circuit are conducted according to one embodiment via the electrical contact and counter-contact device combination.

According to a variant of the refrigeration device of to the invention the electronic unit is fastened to one inner side of one of the planar thermally insulated elements so that this unit is only accessible when the door of the refrigeration device is open. The electronic unit is suitably fastened to the ceiling element or to one of the lateral elements.

According to one embodiment of the refrigeration device of the invention the electrical counter-contact device is arranged on the planar thermally insulated element on which the electronic unit is also arranged. Since the counter-contact device interacts with the contact device fastened to the rear wall the refrigeration device according to the invention then requires only one single electrical connection to connect the entire refrigeration device electronics to the refrigeration circuit. This facilitates not only the assembly of the modular refrigeration device but also reduces the production expenditure and hence also the production costs.

In order to reduce the electricity consumption of the refrigeration device of the invention the lighting device is switched on when the door of the door element is open and is switched off when the door is closed according to a variant of the refrigeration device according to the invention. The lighting device is switched on and off by means of a door opening switch, for example.

In order to reduce the cost of laying the electric cables, for example, a channel is integrated, according to a further variant of the refrigeration device of the invention, inside the housing for feeding through an electric cable. This channel may, for example, have the form of an empty tube or may also be provided for feeding through a refrigeration circuit connection. The channel is advantageously laid in the planar thermally insulated element to which the electronic unit is also fastened. It is particularly advantageous for one end of the channel to lead to the electronic unit and for the other end of the channel to lead to the counter-contact. device, so that both the electricity supply for the electronic unit and the electric cable for the electrical control signals transmitted by the electronic unit for the refrigeration circuit can be conducted in the same channel. This results in a relatively clearly arranged and simple electric cable routing. It is also advantageous for the channel to run in the rear wall and for one end of the channel to terminate at the electrical contact device so that the electricity supply for the electronic unit and the electric cable for the electrical control signals transmitted by the electronic unit for the refrigeration circuit again to be run in this channel.

Figure 2:
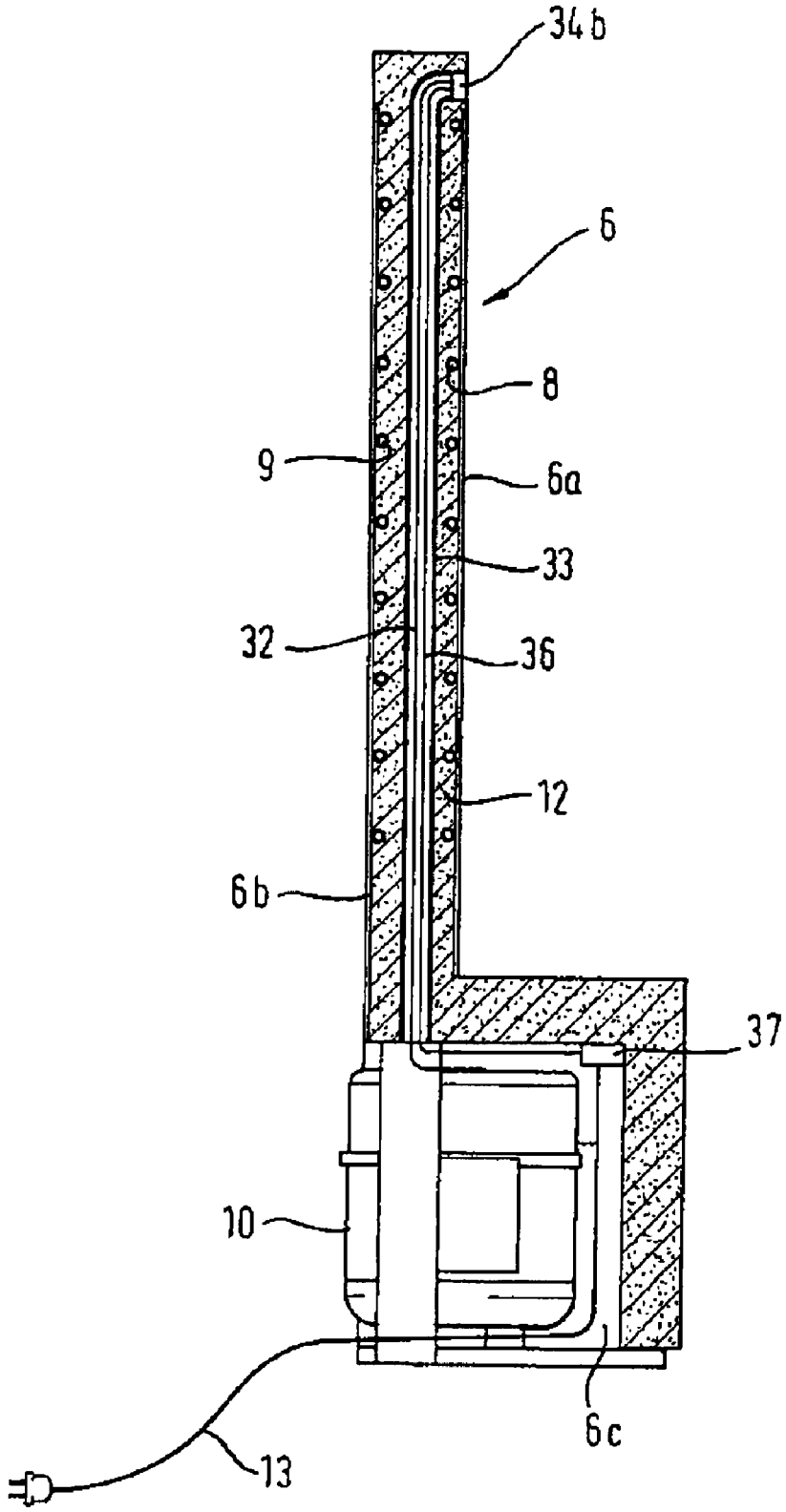
Figure 3:
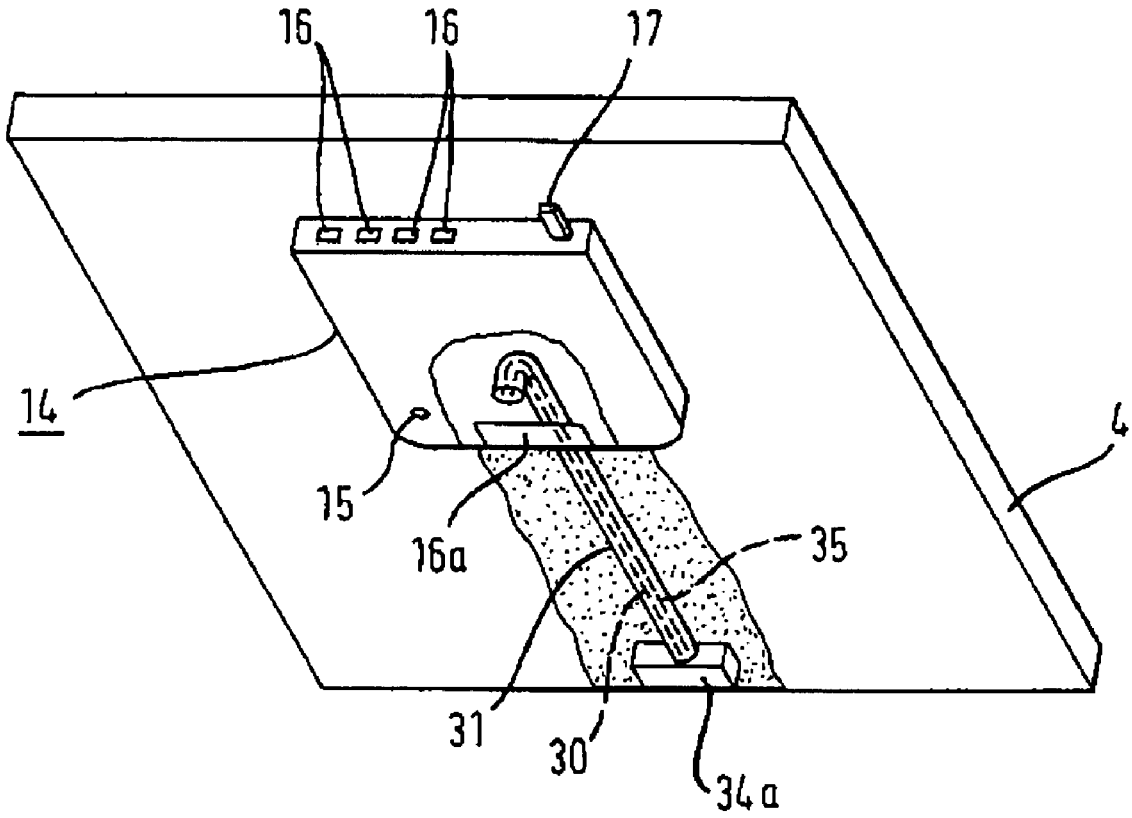
Figure 4:
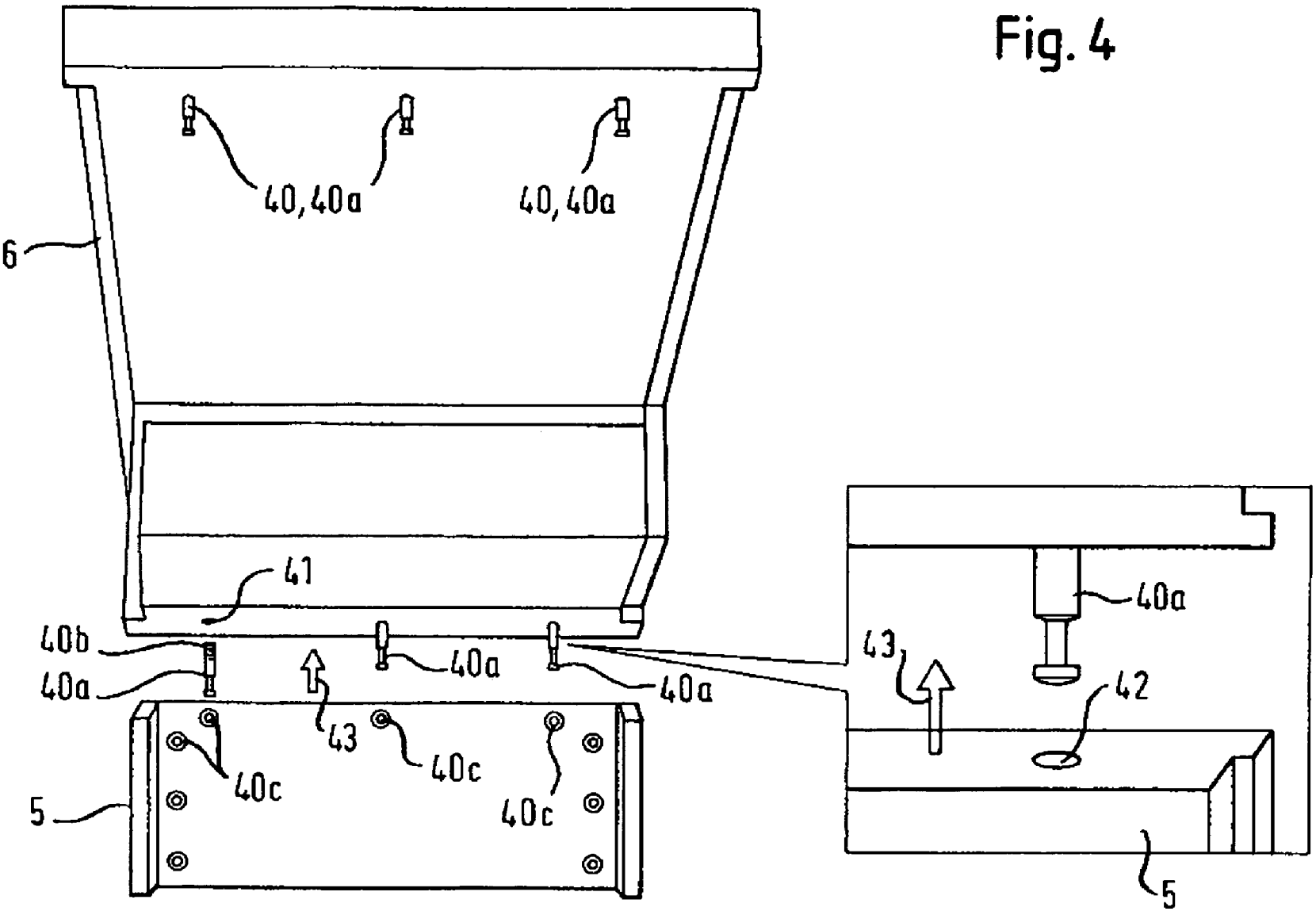
Figure 5:
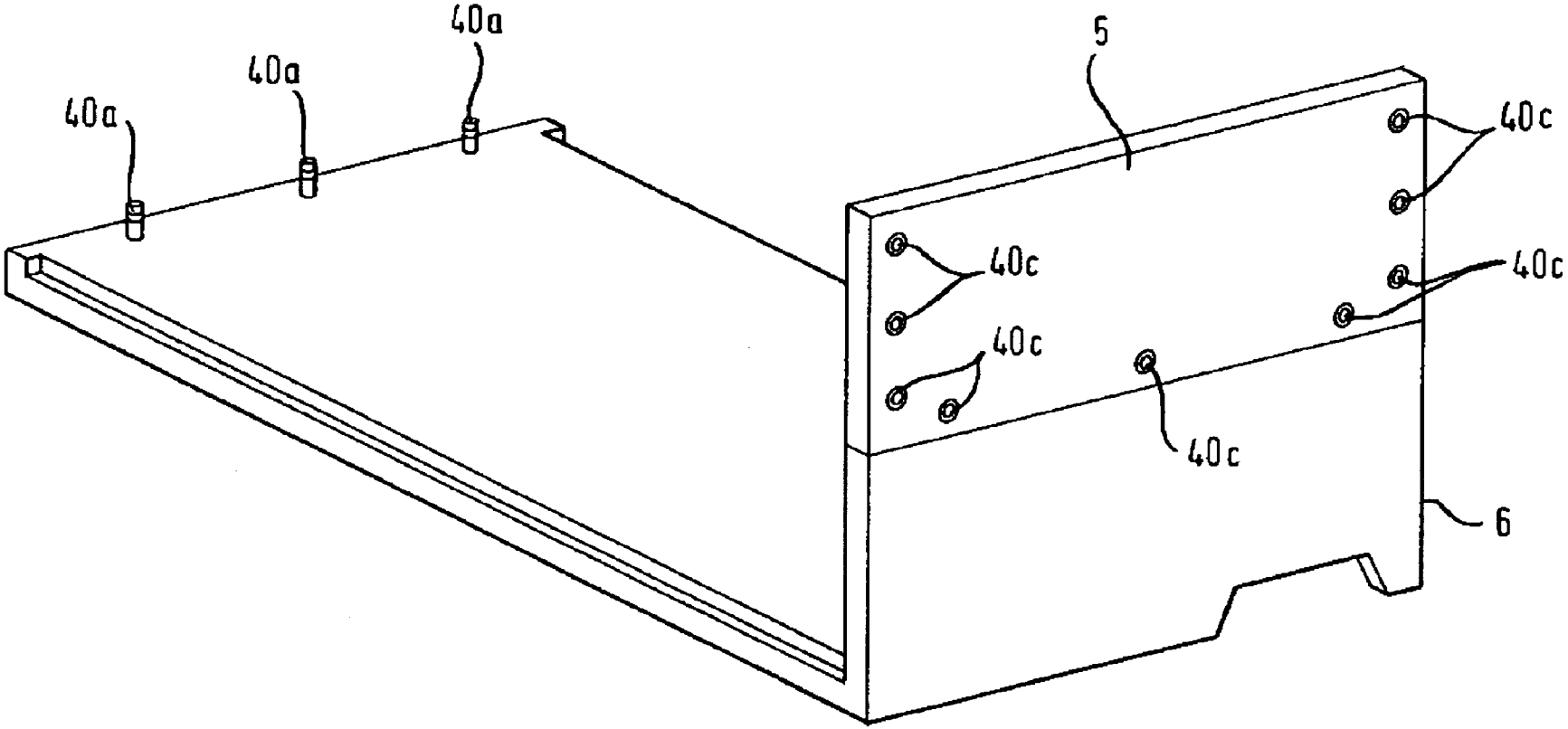
Figure 6:
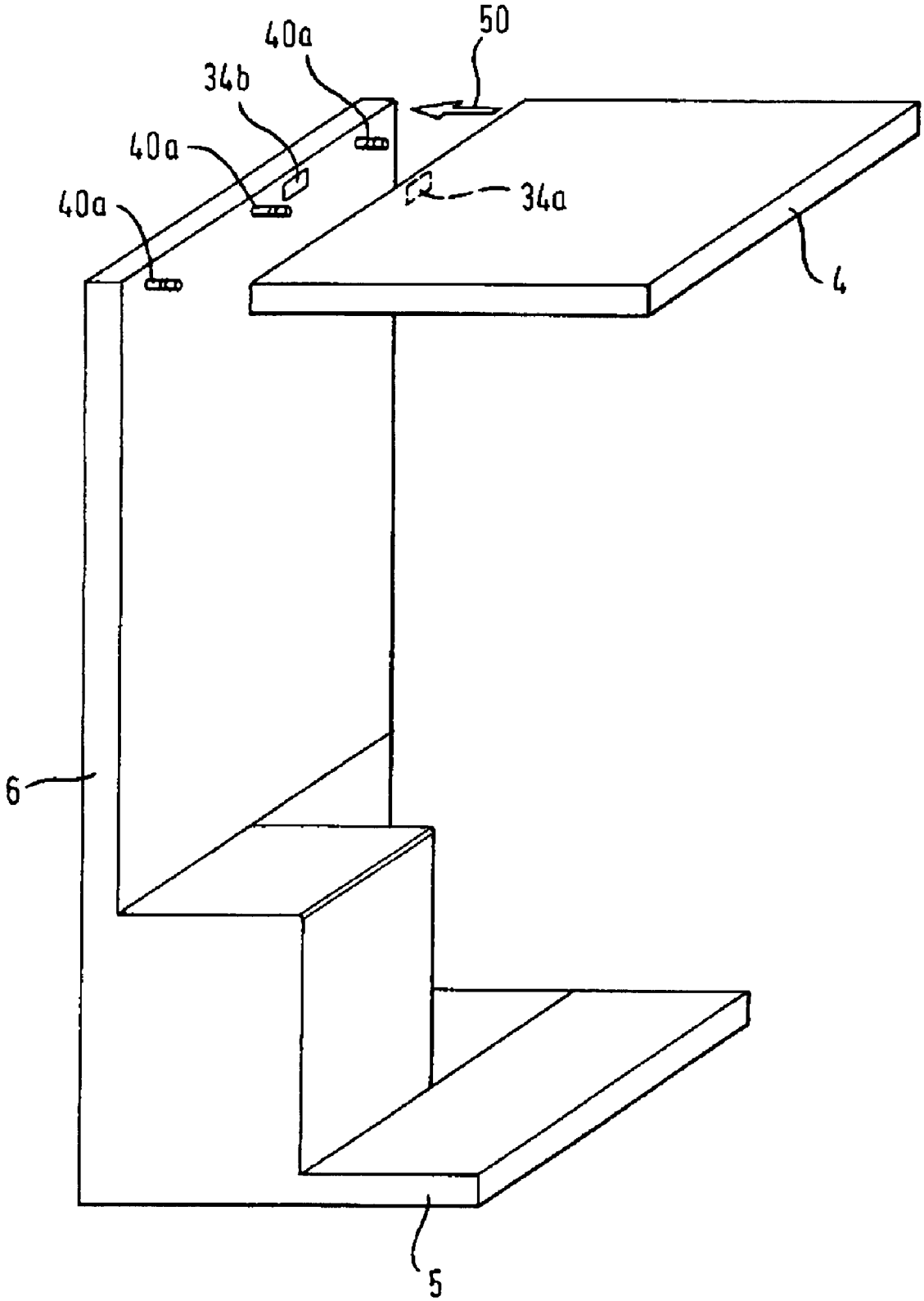
Figure 7:
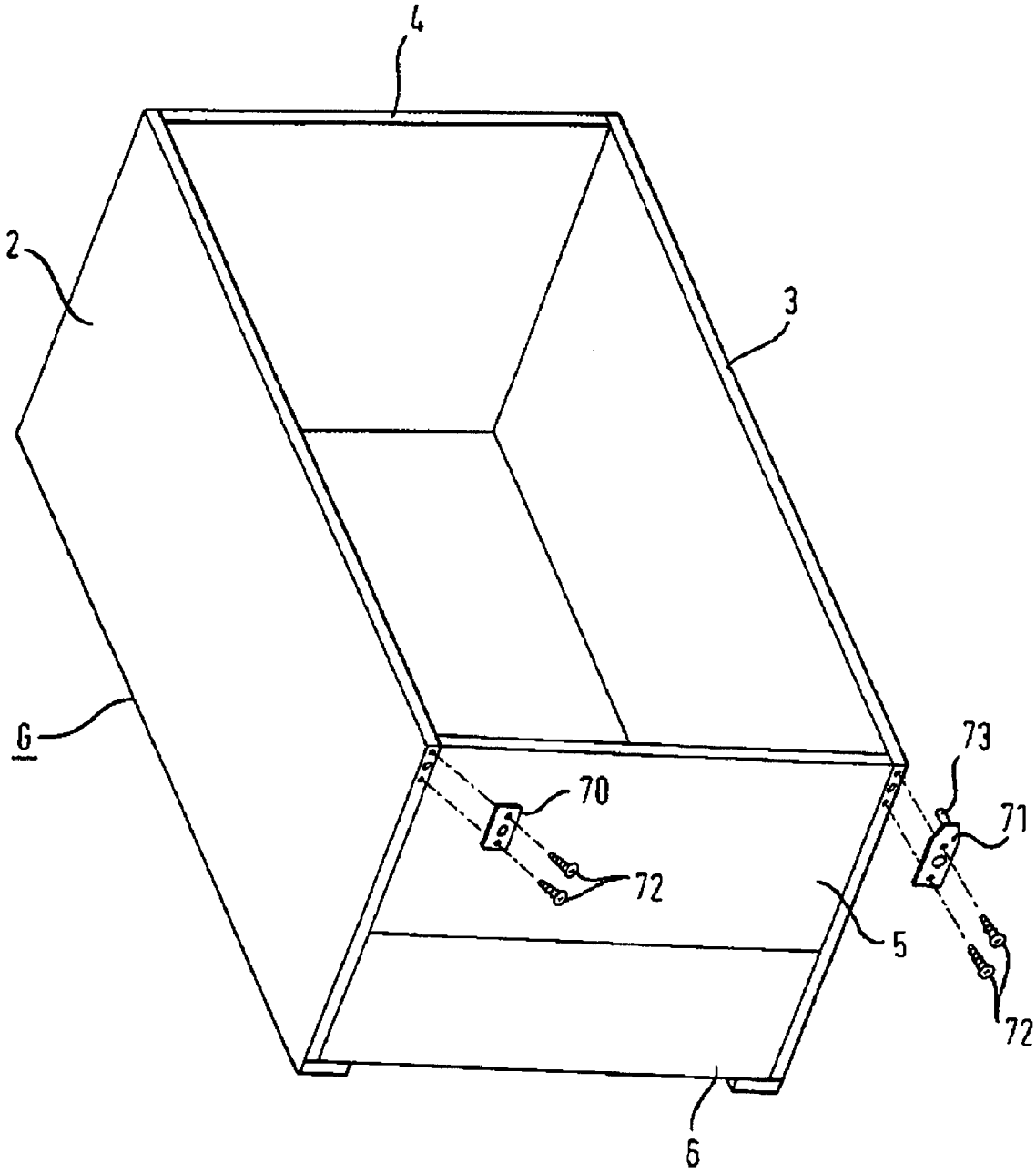
Figure 8:
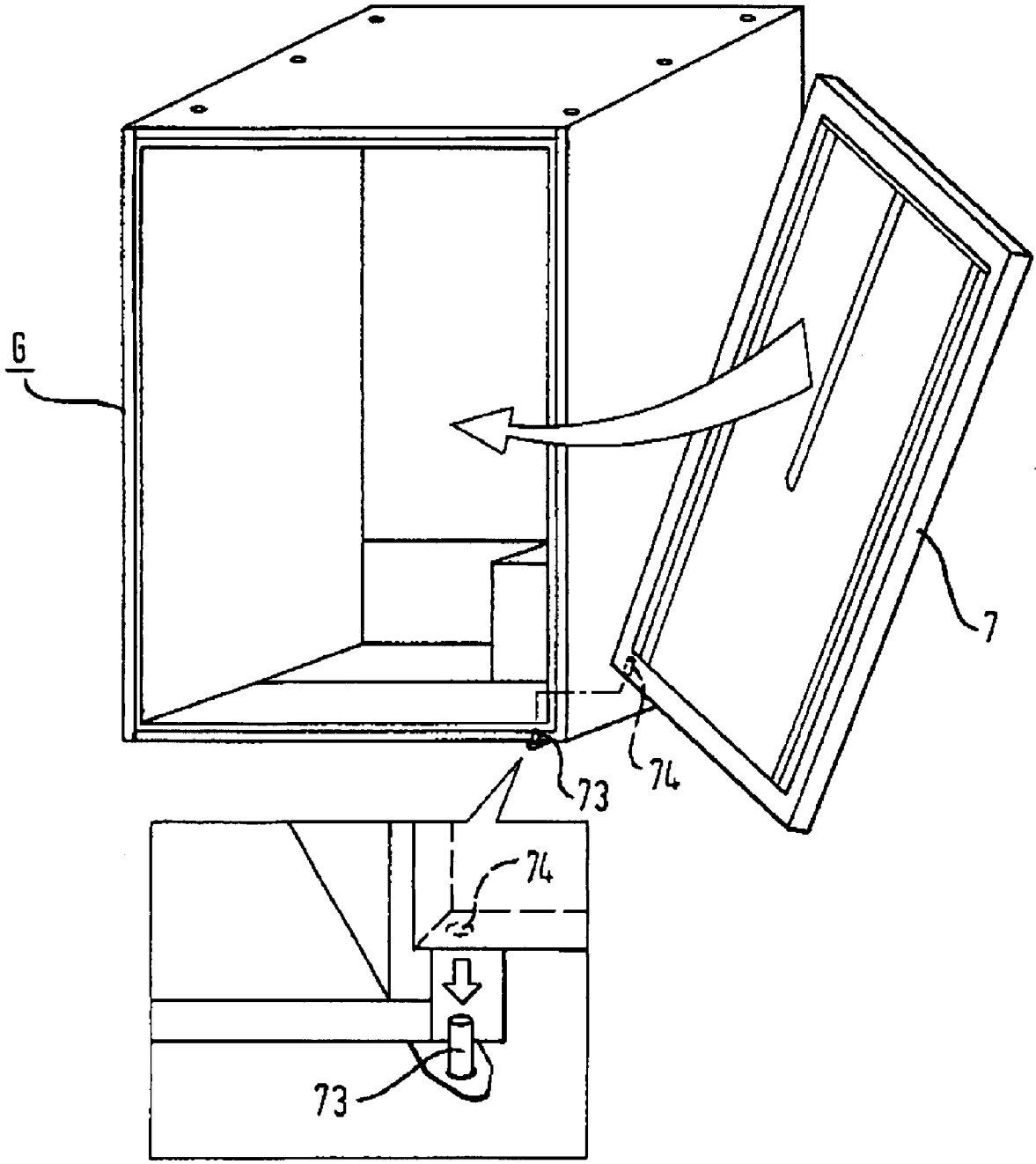
Figure 9:
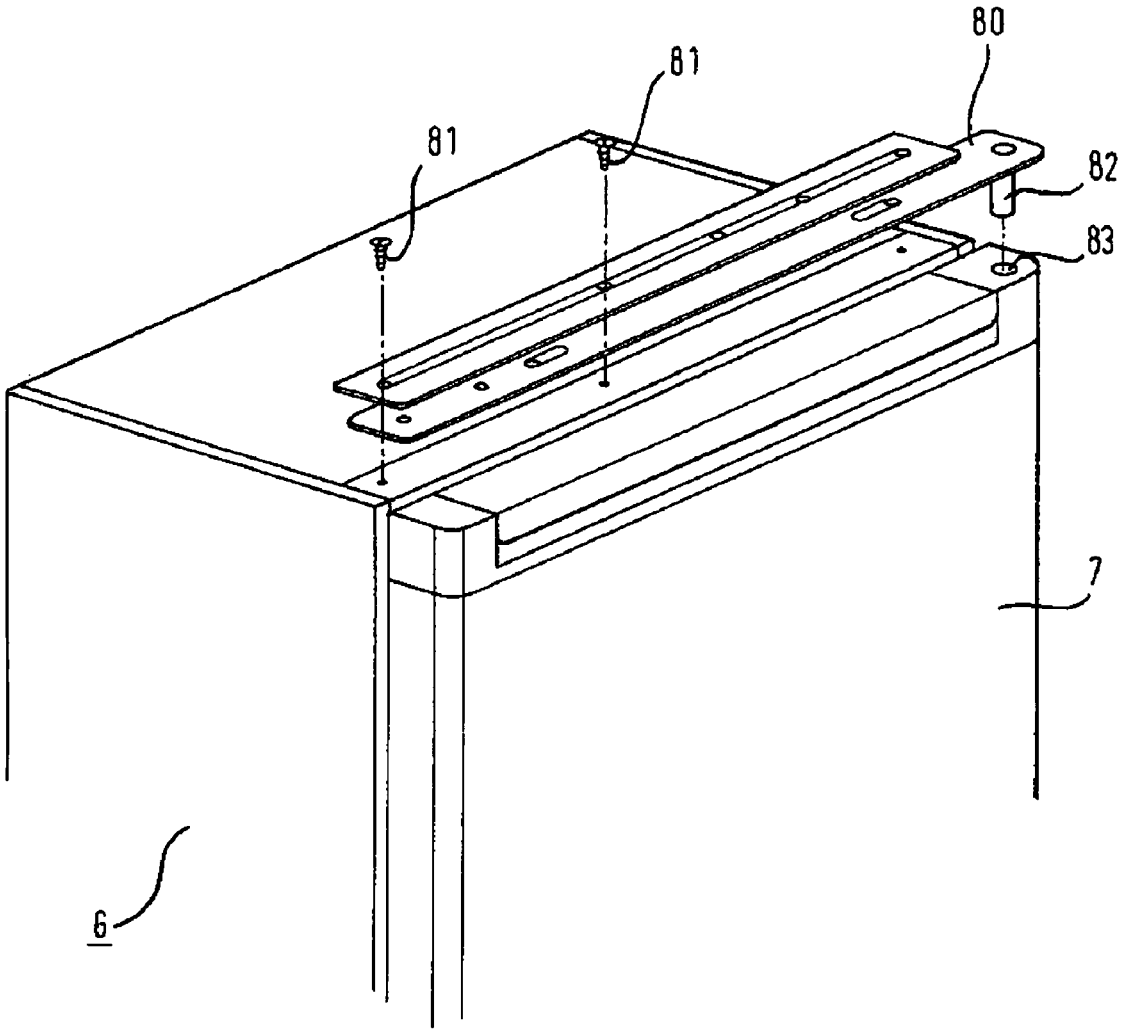

An exemplary embodiment of a refrigeration device according to the invention, which in this exemplary embodiment is a modular refrigeration device, is represented by way of example in the following diagrammatic figures, where:

FIG. 1 shows the modular refrigeration device when assembled,

FIG. 2 shows the rear wall with the refrigeration circuit of the refrigeration device shown in FIG. 1, FIG. 3 shows the ceiling element with an electronic unit of the refrigeration device shown in FIG. 1, FIG. 4 shows the rear wall and the bottom element detached from one another, FIG. 5 shows the rear wall and the bottom element connected together, FIG. 6 shows the rear wall with a bottom element connected to it and a ceiling element detached from it, FIG. 7 shows the fully assembled housing of the refrigeration device, FIG. 8 shows the housing and a door of the refrigeration device unassembled, and FIG. 9 shows the housing of the refrigeration device with partially assembled door.

FIG. 1 shows a modular refrigeration device 1 according to the invention in the assembled, operational condition. Refrigeration device 1 comprises, in this exemplary embodiment, two lateral walls 2 and 3, a ceiling element 4, a bottom element 5, a rear wall 6 and a door 7, which have been assembled together to form refrigeration device 1. Both lateral walls 2 and 3, ceiling element 4, bottom element 5 and rear wall 6 form in this exemplary embodiment housing G of refrigeration device 1, which can be sealed with door 7. An inner device of refrigeration device 1, e.g. drawers or shelves, is not shown in greater detail in the figures. However, a ribbed area R for receiving shelves is shown. Ribbed area R was produced in this exemplary embodiment during a drawing or injection process of the inner lining of lateral walls 2 and 3 surrounding a thermal insulation material. Both lateral walls 2 and 3, ceiling element 4, bottom element 5, rear wall 6 and door 7 are connected to each other so that they can also be detached from each other again.

Both lateral walls 2 and 3, ceiling element 4, bottom element 5, rear wall 6 and door 7 are designed as planar thermally insulated elements and each comprise, in this exemplary embodiment, an inner and an outer lining which enclose a cavity filled with a thermal insulation material. In this exemplary embodiment the thermal insulation material is an insulating foam 12. FIG. 2 shows in further detail, by way of an example, rear wall 6 with its inner lining 6*a* and its outer lining 6*b*.

Furthermore, the entire refrigeration circuit of refrigeration device 1 is fastened to rear wall 6. The refrigeration circuit comprises essentially an evaporator 8, a condenser 9, a compressor 10, cables not shown in further detail in the figures connecting evaporator 8, condenser 9 and compressor 10, and a refrigerant not shown in greater detail. Both evaporator 8 and condenser 9, which in this exemplary embodiment are tube-on-plate heat transmitters which, in this exemplary embodiment are of essentially identical design, are connected in foam to the insulating foam 12 of rear wall 6. Evaporator 8 is here in heat conducting contact with inner lining 6*a*, and condenser 9 is in heat conducting contact with outer lining 6*b*. This enables condenser 9 to discharge its heat relatively effectively to the air surrounding refrigeration device 1 and enables evaporator 8 to cool the interior of housing G of refrigeration device 1 relatively effectively. This also renders it possible to arrange as much insulating foam 12 as possible between evaporator 8 and condenser 9, as a result of which condenser 9 heats evaporator 8 as little as possible.

In this exemplary embodiment rear wall 6 comprises a recess 6*c* arranged in the lower region of rear wall 6, in which recess compressor 10 is fastened. Recess 6*c* is designed so that it is accessible from outside housing G of refrigeration device 1, so that compressor 10 is able to discharge its heat relatively effectively to the air surrounding housing G. In this exemplary embodiment recess 6*c* does not extend throughout the width of housing G. Compressor 10 is also supplied with electricity by means of a mains cable 13.

In this exemplary embodiment the refrigeration circuit was tested before delivery of the disassembled refrigeration device 1 and is fully functional, i.e. refrigeration device 1 is operational as soon as it is assembled and connected to an electricity mains. In this exemplary embodiment refrigeration device 1 also comprises an electronic unit 14 in which all the electronic components of refrigeration device 1 are assembled. Electronic unit 14 is shown in further detail in FIG. 3. In this exemplary embodiment the electronic components comprise a regulating and control unit, not shown in detail, for regulating the inside temperature of refrigeration device 1, a temperature sensor 15 required for this regulation, inputting means 16 for setting the required theoretical temperature of refrigeration device 1, and a lighting system 16*a* for illuminating the interior of housing G. In this exemplary embodiment electronic unit 14 is fastened to the inner surface of ceiling element 4 and comprises a switch 17 which interacts with door 7 so that lighting system 16 is switched on when door 7 is open and switched off when door 7 is closed.

In order to regulate the temperature of refrigeration device 1 electronic unit 14 is electrically connected to compressor 10 when refrigeration device 1 is assembled. In this exemplary embodiment this electrical connection comprises an electric cable 30, which runs in a channel running in ceiling element 4 of refrigeration device 1, which channel is an empty tube 31 in this exemplary embodiment, an electric cable 32, which in this exemplary embodiment runs in a channel running in rear wall 6, which in this exemplary embodiment is an empty tube 33, and an electrical contact and counter-contact device which, in this exemplary embodiment, is an electrical plug-socket device. Socket 34*a* of the plug-socket device is in this case fastened to ceiling element 4 and plug 34*b* of the plug-socket device is in this case fastened to rear wall 6.

In this exemplary embodiment empty tube 33 is packed in insulating foam 12 of rear wall 6 and empty tube 31 is packed in the insulating foam of ceiling element 4. One end of empty tube 31 integrated in ceiling element 4 leads to electronic unit 14, and the other end of empty tube 31 leads to socket 34*a*. One end of empty tube 33 integrated in rear wall 6 leads to recess 6*c* and the other end of empty tube 33 leads to plug 34*b*. Electric cable 30 running in empty tube 31 electrically connects electronic unit 14 to socket 34*a*, electric cable 32 running in empty tube 33 connects compressor 10 electrically to plug 34*b*, and plug 34*b* and socket 34*a* are designed so that when plugged together electronic unit 14 is electrically connected to compressor 10 so that electronic unit 14 activates compressor 10 according to the set theoretical temperature and the actual temperature measured with temperature sensor 15.

An electricity supply provided for electronic unit 14, in the form of electric cables 35 and 36, which are also laid in empty pipes 31 and 33 and are connected to each other by the plug-socket device. Current supply 37 required for generating the low voltage is secured in recess 6*c* of rear wall 6 in this exemplary embodiment.

The assembly of refrigeration device 1 is now explained in further detail with reference to FIGS. 4 to 9. To obtain housing G of refrigeration device 1, bottom element 5 and rear wall 6 are first connected to furniture fittings 40 in this exemplary embodiment. Furniture fittings 40 are designed so that bottom element 5 and rear wall 6 can also be detached from each other, i.e. housing G can also be taken apart. Some of furniture fittings 40 are shown in more detail in FIG. 4. FIG. 4, in conjunction with FIG. 5, also illustrate, by way of example, how rear wall 6 and bottom element 5 are connected to each other by means of some of furniture fittings 40.

In this exemplary embodiment furniture fittings 40 each comprise a metal pin 40*a*, which is provided with a thread 40*b*. In this exemplary embodiment thread 40*b* is, for example, screwed into holes 41 predrilled in rear wall 6 by means of a screwdriver, not shown. One of metal pins 40*a*' is also shown in the unscrewed condition in FIG. 4. The remaining metal pins 40*a*, shown in FIG. 4, are however shown as already screwed into rear wall 6.

After metal pins 40*a* have been screwed into rear wall 6, bottom element 5, which in this exemplary embodiment comprises predrilled holes 42 corresponding to metal pins 40*a*, is presented to rear wall 6 in the direction of arrow 43 so that metal pins 40*a* screwed into rear wall 6 are inserted into holes 42 of bottom element corresponding to them. Metal pins 40*a* are then provided with lock nuts 40*c*, using the screwdriver, so that rear wall 6 and bottom element 5 are fixedly connected to each other, as shown in FIG. 5.

After bottom element 5 and rear wall 6 have been fixedly connected to each other by means of furniture fittings 40, further metal pins 40*a* are screwed into rear wall 6 in holes predrilled for this purpose. These screwed in metal pins 40*a* are shown in FIG. 6 in the screwed connection. Ceiling element 4 is then presented to rear wall 6 in the direction of arrow 50 so that metal pins 40*a* are inserted into holes in ceiling element 4, not shown in FIG. 6, corresponding to them. By inserting metal pins 40*a* of rear wall 6 into the holes of ceiling element 4, socket 34*a* and plug 34*b* fastened to rear wall 6 are also aligned to each other in such a manner that they are automatically connected to each other when ceiling element 4 and rear wall 6 are joined together, so that the electrical contact is made between compressor 10 and electronic unit 14. Finally metal pins 40*a* are provided with lock nuts 40*c* so that rear wall 6 and ceiling element 4 are fixedly connected together.

In order, finally, to assembly housing G completely, both lateral walls 2 and 3 are also connected with furniture fittings 40 to rear wall 6, ceiling element 4 and bottom element 5. The fully assembled housing G is shown in FIG. 7.

In addition, two further fittings 70 and 71 are each screwed onto the lower side of housing G with two screws 72. One of fittings 71 is provided with a pin 73 with which door 7 of refrigeration device 1 can be fastened in a swivelling manner. As illustrated in FIG. 8, door 7 is first placed on pin 73 of fitting 71 for fastening door 7 to housing G. Door 7 is provided with a suitable hole 74 for this purpose.

A further fitting 80 is then screwed by means of screws 81 onto the upper side of housing G, as can be seen in FIG. 9. Fitting 80 comprises a pin 82, which is inserted in a further hole 83 in door 7.

In this exemplary embodiment evaporator 8 and condenser 9 are essentially identical tube-on-plate heat transmitters. In particular, different tube-on-plate heat transmitters may also be used for evaporator 8 and condenser 9. Other types of heat transmitters are also conceivable for evaporator 8 and condenser 9. A roll-bond evaporator is particularly suitable for this purpose.

The refrigeration device according to the invention need not necessarily be a modular refrigeration device, as has been described by way of example. A refrigeration device according to the invention may also have a conventional housing, i.e. a housing which cannot be taken apart again.

The invention claimed is:

1. A refrigeration device comprising a refrigeration circuit containing an evaporator, a condenser and a compressor, as well as electronic components for operating the refrigeration device, wherein all the electronic components are assembled together to form one electronic unit.

2. The refrigeration device according to claim 1, wherein the refrigeration device comprises a plurality of planar thermally insulated elements which can be connected to each other and detached from each other and, when connected, form a housing of the refrigeration device.

3. The refrigeration device according to claim 1, wherein an electricity supply for the electronic unit derives from a rear wall of the refrigeration device and/or the refrigeration circuit is arranged on the rear wall.

4. The refrigeration device according to claim 3, wherein an electrical contact device is integrated in the rear wall, which device automatically contacts electrically, during a mechanical connection of the rear wall to a further planar thermally insulating element, an electrical counter-contact device integrated in this planar thermally insulated element.

5. The refrigeration device according to claim 4, wherein both an electricity supply for the electronic unit and electrical control signals are conducted from electronic unit to the refrigeration circuit by the electrical contact/counter-contact device.

6. The refrigeration device according to claim 2, wherein the electronic unit is fastened to one inner side of one of the plurality of planar thermally insulated elements.

7. The refrigeration device according to claim 6 wherein an electrical counter-contact device is arranged on the one of the plurality of planar thermally insulated elements on which element the electronic unit is also arranged.

8. The refrigeration device according to claim 1, wherein the electronic unit comprises a lighting device for illuminating a housing interior of the refrigeration device.

9. The refrigeration device according to claim 8, wherein the refrigeration device is aligned so that the lighting device is switched off when a door of the refrigeration device is open and is switched off when the door is closed.

10. The refrigeration device according to claim 9, wherein the lighting device can be switched on and off by means of a door opening switch.

11. The refrigeration device according to claim 1, wherein at least one channel is integrated inside a housing of the refrigeration device for feeding through an electric cable or a refrigeration circuit connection.

12. The refrigeration device according to claim 11, wherein the channel is arranged in a planar thermally insulated element to which the electronic unit is fastened.

13. The refrigeration device according to claim 1, wherein the refrigeration device comprises a plurality of planar thermally insulated elements which can be connected to each other and detached from each other and, when connected, form a housing of the refrigeration device, one of the planar thermally insulated elements includes a mechanical connection guide element, another planar thermally insulating element includes a guide corresponding element, an electrical contact device is located on the one of the planar thermally insulated elements, an electrical counter-contact device is located on the another planar thermally insulating element, the mechanical connection guide element of the one planar thermally insulated element and the guide corresponding element of the another planar thermally insulating element are, in a connected disposition of the one planar thermally insulated element and the another planar thermally insulating element to one another, complementarily engaged with one another in a full guided disposition, the electrical contact device located on the one planar thermally insulated element and the electrical counter-contact device located on the another planar thermally insulating element are configured to be electrically interconnected with one another in the connected disposition of the one planar thermally insulated element and the another planar thermally insulating element to one another, and the mechanical connection guide element of the one planar thermally insulated element and the guide corresponding element of the another planar thermally insulating element are arranged relative to the electrical contact device located on the one planar thermally insulated element and the electrical counter-contact device located on the another planar thermally insulating element such that the electrical contact device located on the one planar thermally insulated element and the electrical counter-contact device located on the another planar thermally insulating element are electrically interconnected with one another only if the mechanical connection guide element of the one planar thermally insulated element and the guide corresponding element of the another planar thermally insulating element are complementarily engaged with one another in the full guided disposition.

14. The refrigeration device according to claim 13, wherein the electrical contact device located on the one planar thermally insulated element is a plug and the electrical counter-contact device located on the another planar thermally insulating element is a socket.

15. The refrigeration device according to claim 14, wherein the mechanical connection guide element of the one planar thermally insulated element includes a pin and the guide corresponding element of the another planar thermally insulating element includes a hole configured to receive the pin.

16. The refrigeration device according to claim 1, wherein the refrigeration device comprises a plurality of planar thermally insulated elements which can be connected to each other and detached from each other and, when connected, form a housing of the refrigeration device, one of the planar thermally insulated elements includes a mechanical connection guide element, another planar thermally insulating element includes a guide corresponding element, an electrical contact device is located on the one of the planar thermally insulated elements, an electrical counter-contact device is located on the another planar thermally insulating element, the mechanical connection guide element of the one planar thermally insulated element and the guide corresponding element of the another planar thermally insulating element are, in a connected disposition of the one planar thermally insulated element and the another planar thermally insulating element to one another, complementarily engaged with one another in a full guided disposition, the electrical contact device located on the one planar thermally insulated element and the electrical counter-contact device located on the another planar thermally insulating element are configured to be electrically interconnected with one another in the connected disposition of the one planar thermally insulated element and the another planar thermally insulating element to one another, and the mechanical connection guide element of the one planar thermally insulated element and the guide corresponding element of the another planar thermally insulating element are arranged relative to the electrical contact device located on the one planar thermally insulated element and the electrical counter-contact device located on the another planar thermally insulating element such that the electrical contact device located on the one planar thermally insulated element and the electrical counter-contact device located on the another planar thermally insulating element are automatically electrically interconnected with one another upon complementary engagement of the mechanical connection guide element of the one planar thermally insulated element and the guide corresponding element of the another planar thermally insulating element with one another in the full guided disposition.

17. A refrigeration device, comprising:

a housing having a plurality of housing walls; and an electronic components box including all electronic components that control operation of the refrigeration device, the electronic components box positioned inside the housing on one of the plurality of housing walls.

* * * * *